United States Patent [19]

Grearson

[11] 4,074,486

[45] * Feb. 21, 1978

[54] PANEL WALL CONSTRUCTION

[75] Inventor: Kenneth R. Grearson, Park Ridge, Ill.

[73] Assignee: Multuloc Corporation, Chicago, Ill.

[ * ] Notice: The portion of the term of this patent subsequent to Aug. 17, 1993, has been disclaimed.

[21] Appl. No.: 705,472

[22] Filed: July 20, 1976

Related U.S. Application Data

[63] Continuation-in-part of Ser. No. 625,147, Oct. 23, 1975, Pat. No. 3,974,608.

[51] Int. Cl.[2] ..... E04B 2/38

[52] U.S. Cl. ..... 52/235; 52/282; 52/463; 52/495

[58] Field of Search ..... 52/509, 282, 460, 461, 52/479, 481, 235

[56] References Cited

U.S. PATENT DOCUMENTS

| | | | |
|---|---|---|---|
| 1,865,131 | 6/1932 | Olsen | 52/495 X |
| 2,013,762 | 9/1935 | Olsen | 52/495 X |
| 2,101,952 | 12/1937 | Olsen | 52/349 X |
| 3,457,698 | 7/1969 | Albers | 52/495 X |
| 3,974,608 | 8/1976 | Grearson | 52/282 X |

*Primary Examiner*—Alfred C. Perham
*Attorney, Agent, or Firm*—Thomas W. Speckman

[57] ABSTRACT

A panel wall construction using box-tee sheet metal shapes wherein the panels may be inserted in channels of the sheet metal shape or clips may be inserted in slots between the channels of the sheet metal shapes to hold the panels. These same shapes may be used for mullions, base sills, top caps and horizontal stiffeners and horizontal joint assemblies thereby producing a panel wall system wherein no screw-type fasteners are required to hold the panels in place. Disclosed clips hold the box-tee sheet metal shapes and the panels. The disclosed panel wall construction provides a very light weight construction which has great flexibility with respect to panel thickness and width as well as great flexibility of design to accommodate wind loadings.

9 Claims, 6 Drawing Figures

PANEL WALL CONSTRUCTION

CROSS REFERENCE TO RELATED APPLICATION

This application is a continuation-in-part of my copending application, Ser. No. 625,147, filed Oct. 23, 1975 now U.S. Pat. No. 3,974,608.

This invention relates to exterior wall construction of the type utilizing wall panels carried by spaced panel carrying structural members. More particularly, the panel wall construction of this invention relates to the utilization of sheet metal shapes which are readily fabricated by roll forming having at one end a generally hollow box shaped section, one of the sides of the box shape being split in approximately its mid-portion and having opposing legs extending at approximately right angles to the split box wall for a distance suitable to carry a desired panel thickness, each of the opposing legs then turning approximately 90° to form flanges extending in opposite directions from each leg and approximately parallel to the split box walls. Various types of clips may be inserted between the opposing legs and extend in a locking manner into the interior of the open box section for securely fastening panels between such clips and the surfaces of the flanges away from the box portion of the sheet metal shape. It is a feature of this invention that the entire panel wall may be constructed without the need for conventional fastening means such as screws, bolts and rivets to secure the panels thereby permitting rapid and efficient on-the-site erection. It is a feature of this invention that the same type of sheet metal structural shape may be used as a bottom sill, top cap, vertical mullion, corner assembly, and horizontal joint assembly, thereby locking intervening panels and structural shapes into a solid assembly. The panels, interior and exterior, as well as adjacent panels of differing thickness including glass, may be readily erected with no conventional screw, rivet or welding fasteners being required. The wall construction of this invention presents great flexibility with respect to both vertical and horizontal spans, differing module dimensions, ease of erection and ease of removal of the structure including damdaged panel replacement.

Prior attempts have been made to provide wall systems which do not require screw-type fasteners for holding panels in place. Some such systems are illustrated by U.S. Pat. Nos. 3,732,659 3,339,329, 3,553,915 and 3,418,772. However, such prior methods of wall construction did not have sufficient versatility to provide the desired flexibility of construction of various wall systems. For example, prior wall systems have required different structural shapes for the bottom sills, top caps and for the mullions. Prior conventional wall construction has necessitated the erection of a steel support framework with intermediate girts and their associated hanger rods to prevent excess deflection and sub-girts followed by panel attachment. Conventional wall construction requires scaffolding to fasten the wall panels to the mullions and sub-girst. The wall construction of this invention may eliminate sub-girts, the sheet metal shape being the load carrying element. In prior building walls, the wind loading, both positive and negative, is accommodated by backing the panels with sub-girts and like structures, the resistance to negative loading frequently being limited to screw-type fasteners.

It is an object of this invention to overcome many of the disadvantages of prior art wall construction.

It is another object of this invention to provide a panel wall construction which eliminates the necessity for screw-type fastenings in its erection.

It is still another object of this invention to provide a panel wall construction which has high resistance to both positive and negative wind loading forces.

It is another object of this invention to provide a panel wall construction wherein adjacent panels may be of widely varying thicknesses.

It is yet another object of this invention to provide a panel wall system utilizing roll formed sheet metal structural shapes wherein the same type of structural shape is used for upper caps, lower sills, mullions and horizontal stiffeners and horizontal joint assemblies.

It is another object of this invention to provide locking clips for holding the sheet metal structural shaped in desired relationship to other structural components.

These and other objects of the invention will become apparent upon reading the following description and by reference to the drawings wherein.

Figure 1:
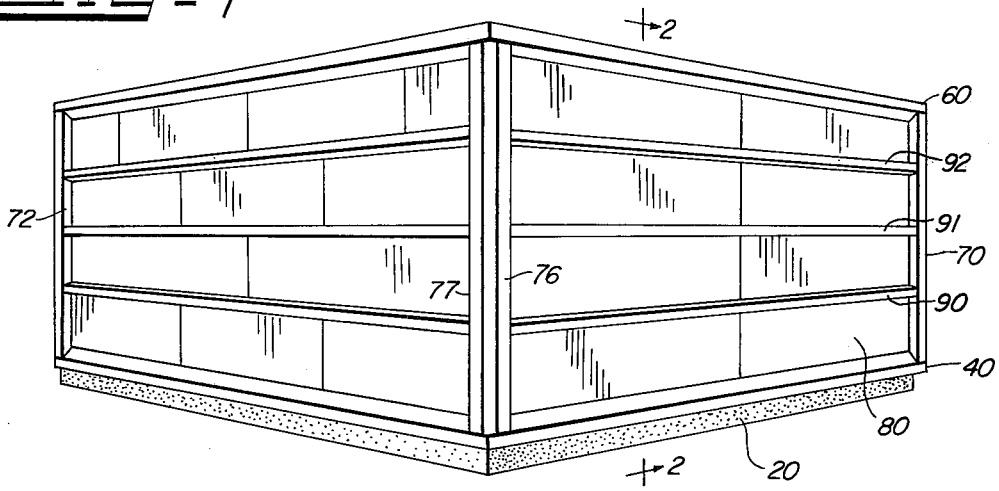
FIG. 1 is an exterior perspective view of the corner of the exterior wall of a builing utilizing one embodiment of this invention with horizontal panels.

FIG. 1 shows one horizontal wall system according to this invention. From FIG. 1 it is seen that the box portion of the sheet metal shape such as sill 40 is exposed to he exterior of the wall while the panels are toward the interior. The wall structure of FIG. 1 uses the same roll formed sheet metal shape 40, best seen in FIG. 3, as a lower sill attached to foundation 20, as vertical mullions 70 and 72, corner mullions 76 and 77, as top cap 60 and as horizontal stiffeners and joint members 90, 91 and 92, with panels 80 forming the wall closure. The wall construction as shown in FIG. 1 does not have any interior framework such as sub-grits, but only requires a structural framework at the top and bottom of the wall. FIG. 1 shows a wall having four panels in height. It is one feature of this invention that the entire length may be spanned by one panel or as many panels as desired to obtain desired color or architectural effect.

Figure 2:
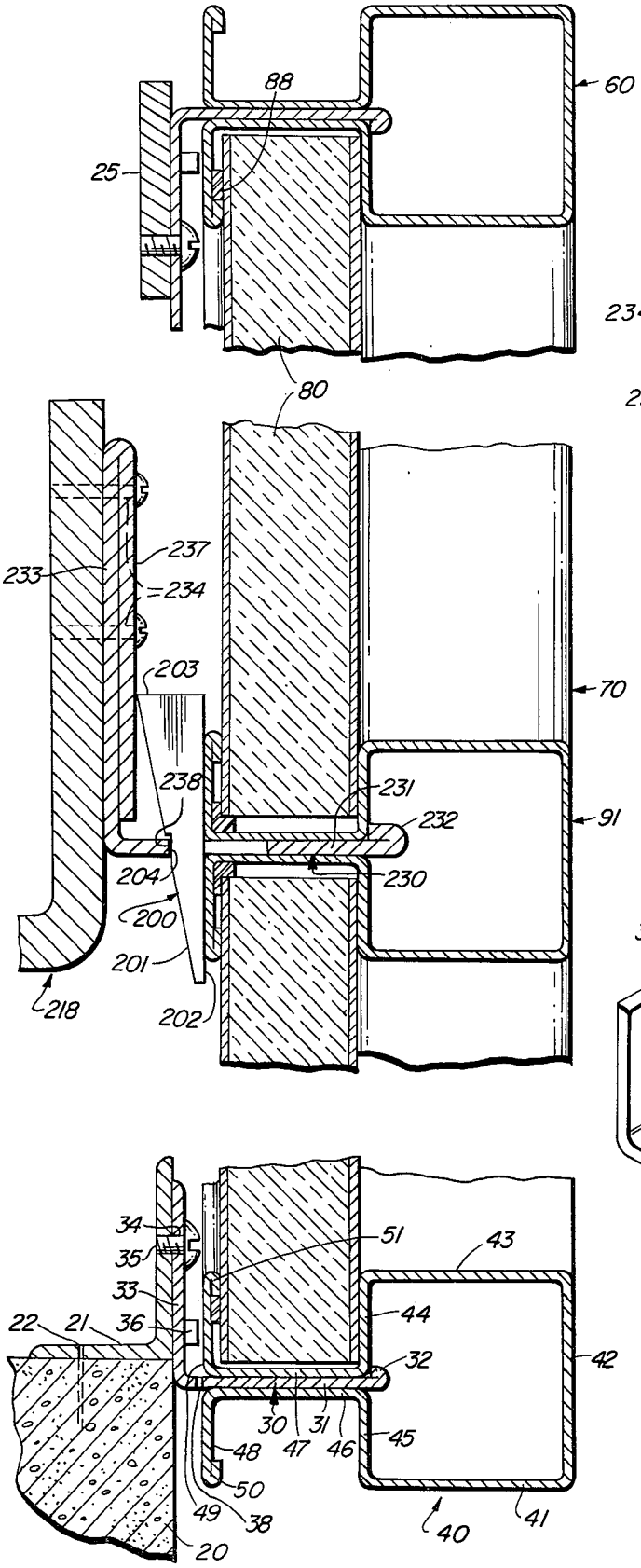
FIG. 2 is a cross section of a portion of the structure as indicated in FIG. 1.

FIG. 2 shows the mounting of the wall system of this invention to the building structure made up of the foundation and structural framework. The sheet metal structural box tee shape is shown as 40 having three adjacent box walls 41, 42, and 43 with the fourth box wall being split into two equal segments 44 and 45. From the ends of the split box walls 44 and 45, opposing legs 47 and 46 extend away from the box section at about 90° for a distance sufficient to accommodate the width of the desired panel 80. At their outer ends, opposing legs 46 and 47 are bent to extend away from each other at approximately 90° forming flanges 48 and 49, respectively. The ends of flanges 48 and 49 may be turned inwardly back upon themselves forming flange end turnback 50 and 51 to stiffen the edges of the flanges and to provide a smooth contact surface for the panels which may impart some spring action to the flanges when the panels are inserted.

FIG. 2 shows foundation 20 having foundation angle 21 mounted along its upper outer edge by foundation angle fastening 22. The vertical leg of foundation angle 21 may extend upward or downward as desired. As shown in FIG. 2, the foundation angle extends upwardly from the concrete foundation and may have fastening hole 23 for acceptance of clip fastener 35. Clip 30 may be welded, screwed or power fastened to foundation angle 21. Clip 30 and its manner of use is one important feature of this invention. As is seen in FIG. 2, clip 30 has body portion 31 with the end of the body portion forming locking end 32 by being turned over upon itself. The opposite end of body portion 31 has clip leg 33 at right angle to the body portion. Clip leg 33 may have clip fastener hole 34 through which clip fastener 35 may hold sheet metal clip 30 to foundation angle 21.

The top of the wall as shown in FIG. 2 is fastened to structural frame 25 in a similar manner as described above for the bottom sill. Sheet metal structural shape 60 is installed over the top of panel 80 as a top cap and fastened to the structural frame.

The wall construction according to this invention is very light weight with the gravity load of the wall being carried by clips 30. Clips 30 are not continuous but may be of any desired length necessary for the support of the wall. Sufficient clips are installed to carry the desired wall load. Both vertical and horizontal alignment of the bottom of the wall according to this invention are very easily obtained by establishing the centerline of the base sill, installing sufficient clips along that line and impaling bottom sill sheet metal shape 40 on the clips. Shims or resilient sealing strip 36 bring base sill 40 into desired horizontal alignment. Prior to installation of the panels weep holes 38 may be drilled to provide drainage. The construction of this invention avoids the necessity, as presently encountered, of leveling the wall to the top of a concrete foundation. Utilizing the wall construction of this invention, the top of the foundation may be considerably out of level as long as a suitable fastening for clips 30 is provided, such as foundation angle 20 as shown in FIG. 2.

Figure 4:
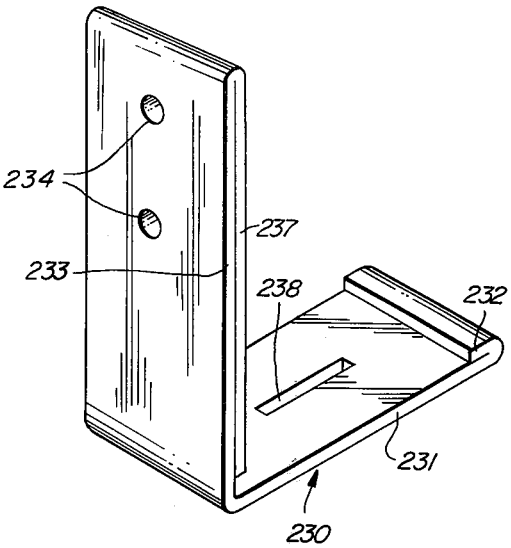
FIG. 4 is a perspective view of a clip according to one embodiment of this invention.

Another embodiment of wall securement according to this invention is shown in the central portion of FIG. 2. The central portion of FIG. 2 shows the horizontal stiffener and panel carrying member using the same roll formed sheet metal structural shape as used for mullions, lower sills and upper caps. This embodiment of the invention shows use of clip 230 which is more clearly shown in FIG. 4. FIG. 4 shows clip 230 having body portion 231 with one of body portion 231 forming locking end 232 by being turned over upon itself. The opposite end of body portion 231 has clip leg 233 at right angle to the body portion. Clip leg 233 may be turned back upon itself forming stiffener leg 237 which improves the strength in the region of clip fastening hole or holes 234.

Figure 6:
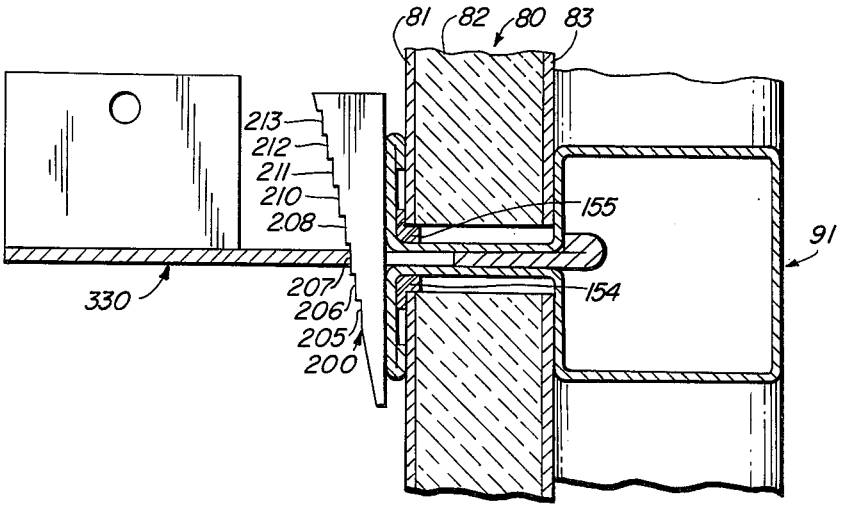
FIG. 6 is a cross-sectional view of a portion of the structure of this invention showing use of the clip shown in FIG. 5.
Figure 5:
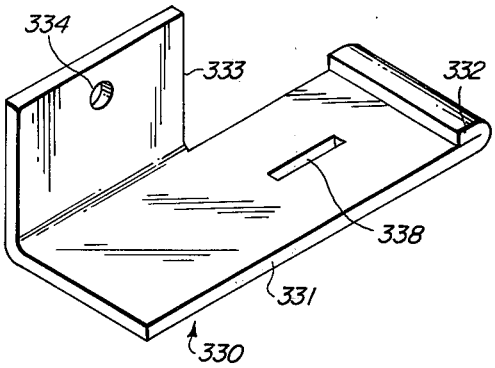
FIG. 5 is a perspective view of a clip according to another embodiment of this invention.

Clip body portion 231 has open slot 238 to receive wedge 200, as seen in FIG. 2. Wedge 200 has straight edge 202 and opposite angular edge 201, the distance between these edges increasing to top edge 203. Angular edge 201 may have one or more steps, seen as step 204 in FIG. 2 and steps 205 through 213 in FIG. 6, to lock wedge 200 securely in desired position in slot 238. A clip such as clip 230, FIG. 4, is used when fastening to a surface parallel to the plane of the wall. A clip such as clip 330, FIG. 5, is used when fastening to surfaces at an angle to the plane of the wall, as shown in FIG. 6.

When it is desired to fasten the horizontal stiffeners and joing members to a structural frame system, as indicated schematically by section 218 in the central portion of FIG. 2, the assembly of clip 230 and wedge 200 may be advantageously used. It is seen that by utilization of wedge 200, the wall itself and roll formed structural shape 91 are securely held away from the primary structure by having body portion 231 of clip 230 of desired length and slot 238 in desired position so that wedge 200 securely locks in position. The clips as shown in FIGS. 4 and 5 are suitable for use in both the horizontal and vertical panel configurations according to this invention.

The end of each horizontal panel assembly may have vertical end mullions of the same structural shapes as described. The end mullions are aligned with the horizontal panel carrying members to accept the ends of the panels in the channel of the mullions locking the horizontal and vertical shapes and panels into a rigid structure. Any other suitable vertical end structure may be used.

FIG. 4 of the U.S. Pat. No. 3,974,608, shows a corner cross-sectional detail of the structure as shown in FIG. 1 wherein one flange portion of mullion 77 is inserted between the opposing legs of mullion 76 which, together with locking action of panels 80 into the lower and upper sills, provides adequate rigidity to the corner structure. It is apparent that by simply bending the flange which is inserted in the slot between the opposing legs of the adjacent mullion, that any desired angle smaller than 90° between panels may be obtained by bending one flange of each of the adjacent mullions until the box shaped section of the mullion interferes. Of course, the lower sill and upper cap are also adjusted to the desired angle to carry the corner structure. Using the corner structure as described above, it is possible to make a closed cube without the use of conventional fasteners.

After the lower sill structural shape such as 40 is attached to the structural position of the building, several methods of construction may be utilized. A pair of vertical mullions having the same shape as sheet metal structural shape 40 may be erected by simply placing them upon sheet metal shape 40 such as 70 and 76, as shown in FIG. 1, and fastening them to structural steel frame 25 at the top by use of clips identical to the clips described above. After the mullions have been so erected, the panels may be slid between adjacent mullions as shown in FIG. 1, from the top to form one height of panels. When it is desired to use several panels to obtain the desirred height, as shown in FIG. 1, the panels may very simply be connected by use of the same sheet metal shape used as a horizontal stiffener and assembly between adjacent horizontal levels of panels as shown in FIG. 1 and in more detail in the central portion of FIG. 2. One panel or any desired number of panels may span the horizontal distance between adjacent mullions and may be sealed together in the manner shown in FIG. 3 and associated description of U.S. Pat. No. 3,974,608, by use of caulk strip 86 making sealed contact between panel edge 84 and panel edge 85. Caulk strip 86 is most conveniently attached to panel edge 84 prior to its being inserted between the mullions from the top. Then, it is only necessary to insert one horizontal layer of one panel or several panels from the top and push down until the lowermost panel layer locks in bottom sill 40 as shown in FIG. 2 locking the adjacent mullions into fixed relationship with bottom sill sheet metal shape 40. Then horizontal shape 90 is locked into place over the lowermost row of panels and another row of panels and horizontal shape is assembled in the same manner. This process is continued until the uppermost panel row is in place locking the mullions into fixed relationship with top cap 60 which is put into place after the uppermost panels have been installed. Thus, it is seen in each module of wall construction that the panels are locked into position by the mullions, horizontal stiffener-joint members, and the upper and lower sills in a fashion such that they will withstand wind loading from either side.

Another method of erection of the wall as shown in FIG. 1 is to secure a first mullion in position at top and bottom and then place the horizonral panels and horizontal stiffener-joint members in position from the side followed by placing the next adjacent mullion in position, thereby locking the module of panels and horizontal stiffener-joint members in position. Utilizing this type of erection is preferred to tighten the vertical joints between panels when multiple panels are used in a horizontal row. The second mullion can be put in place and horizontal pressure applied while securing the second mullion at top and bottom.

Another mode of erection of the horizontal wall structure of this invention is to preassemble as an assembly unit the necessary panel or panels and horizontal panel carrying members to one mullion. The preassembly can be accomplished at a factory under controlled conditions and thereby considerably reduce field labor and serve to control quality of the wall construction. The wall panels of the pre-assembled panel-horizontal stiffener-joint member-mullion assembly protrude beyond the bottom and top of the mullion for a sufficient distance to fully engage lower sill 40 and upper cap 60, respectively. The panel-mullion assembly is raised into position using a crane or other suitable hoisting equipment and lowered into place so that the protruding portion of the lower panel engages the slot of the lower sill 40 as shown in FIG. 2. The upper cap 60 may be placed and secured to structural frame 25 as previously taught, utilizing the sheet metal clips.

Yet another mode of erection of the wall structure of this invention is to preasemble as an assembly unit of horizontal panels with an end mullion on each end with erection leaving spaces between adjacent assemblies to accommodate vertical panels of desired width. Thus, the filler panels can be slid into the channels of the mullions from the top, locking the structure together.

It is readily seen from the above description that great freedom is available with respect to panel carrying structural member spacing which is principally governed by the type of panel used and the architectural effect desired. Various combinations of vertical and horizontal panel assemblies may be used. Both the horizontal and vertical spacings may be adjusted to accommodate desired buidling module and height requirements when standard panels available are not of suitable width. To achieve desired architectural effects, various panels might be metallic clad insulating panels while other panels might be architectural glass, plastic, or other material. It is readily seen that the flexibility of both horizontal and vertical spacing made possible through utilization of the wall construction of this invention opens new and boundless possibilities for achievement of dramatic architectural effects.

The flexibility of stiffener spacing offered by the wall construction of this invention also makes it easier to obtain desired wind loadings with specifically desired panels. For example, the panels may be cut in half and three horizontal stiffeners placed in the space that two horizontal stiffeners would normally be spaced to obtain higher wind loadings without any change in the basic structure nor in the structural frame.

The above described walls as shown are single panel thickness walls. The panels, such as 80 shown in FIGS. 1, 2 and 6, are conventional sandwich insulated core panels having a hard surface on both side 81 and side 83, frequently of metal, andd an inner core 82 of insulating material, frequently foamed synthetic polymer such as polystyrene or polyurethane. The panels for use in the wall system previously described are of a thickness to suitably engage the channels provided by the sheet metal box shapes such as 40. To facilitate such engagement, the edges of sandwich type panels may be slotted to permit the panels to be squeezed into the channels. It is apparent that any suitable wall panel may be utilized and panels that are too thin may be shimmed to firmly engage the channel of sheet metal structural shape 40 by use of appropriate filler strips and/or caulking materials. A double panel wall may be obtained by alternate spacing of reversed horizontal stiffener-joint member, that is, the box portions of the horizontal members being aligned side-by-side while the portion of the horizontal members for receiving the panel wall is on opposite sides. In a wall thus constructed, the panels are in contact with the back of the intermediate box portion of the alternate horizontal members. For further spacing between a double wall, the horizontal members and mullions can be placed back-to-back. With appropriate upper cap and lower sill structural shapes as previously described, a double panel wall is readily obtained.

Figure 3:
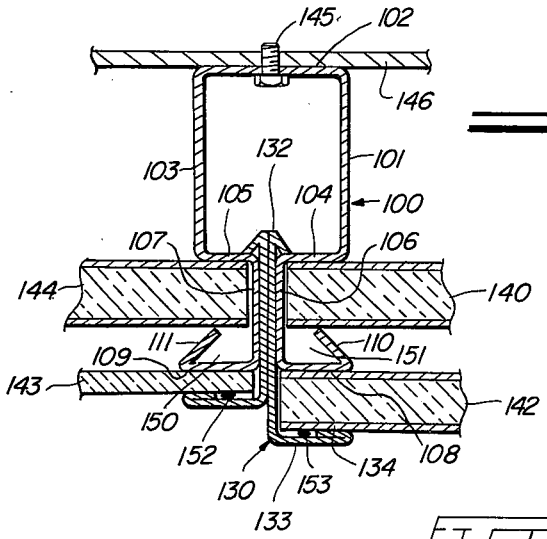
FIG. 3 is a cross-sectional view showing another embodiment of a roll formed sheet metal shape used in this invention showing adjacent panels of widely varying thickness and a separate insulating layer.

Referring to FIG. 3, a cross-sectional view of yet another embodiment of this invention is shown. Sheet metal section 100 shows a sheet metal structural box tee shape which functions in a similar manner as the sheet metal box tee shape described with respect to FIG. 2. However, the shape as shown in FIG. 3 is better adapted to being roll formed from heavier gauge metal and provides for larger and stiffer wall structures. The sheet metal structural shape is shown as having three adjacent box walls 101, 102 and 103, with the fourth box wall being split into two equal segments 104 and 105. From the ends of the split box walls 104 and 105 opposing legs 106 and 107 extend away from the box section at about 90° for a distance sufficient to accommodate the width of the desired panel, such as 140. At their outer ends, opposing legs 106 and 107 are bent to extend away from each other at approximately 90° forming flanges 108 and 109, respectively. The ends of flanges 108 and 109 are turned inwardly to form an angle of less than 90°, preferably about 45° to 75° with the respective flanges to stiffen the edges of the flanges and to provide contact surface for the panels inserted between the ends of the turned back portions and the opposing split sides of the box section. A wall similar to that shown in FIGS. 1 and 2 may be constructed substituting the sheet metal structural shapes 100 for those shown, such as 40, 60, 70, 72, 76, 77, 90, 91 and 92.

FIG. 3 shows another feature of this invention which is applicable to wall constructions utilizing either the box shape shown in FIG. 2 or as shown in FIG. 3. In this embodiment, panels are held adjacent the flanges of the sheet metal structural shape by clips which are secured in firm engagement with the sheet metal shape by inserting a portion of the clip betweeen the opposing legs of the structural shape. Panel clip 130 is shown in position securing panel 42. Panel clip 130 is made up of straight body portion 131 having locking end 132 at one end and clip leg 133 at the other end so that after erection of shape 100, panel 142 may be placed into position and clips 130 may be inserted between opposing legs 106 and 107 snapping firmly into position with clip leg 133 holding panel 142 adjacent flange 108 by locking end 132 clipping into position behind split box wall 104. If desired, caulking strip 153 may be inserted so as to lock into position between clip 133 and panel 142. Likewise, the end of clip 133 may be turned over as shown in FIG. 5, to form clip leg turn over 134 which provides spring action to panel clip 130. The panel clips are not continuous but are of suitable length and frequency to provide firm support for panel 142. The clips may be covered by a continuous plastic facing strip which snaps over clip leg 133. Such facing strips may be obtained in a wide variety of colors to achieve desired architectural appearance. In the embodiment shown in FIG. 5, the panel wall is to the exterior of the building from box section 100 which may be fastened to the structural frame work of the building to serve as a bottom sill and top cap by fastening means such as 145. Screw fastener 145 may be driven in place from the inside of box section 100 by forcing legs 106 and 107 apart sufficiently to insert screw 145 and the driving tool. This allows the entire wall assembly to be erected from one side as may be desired in shaft wall construction. This method of screw fastening may also be used in the same manner with structural shapes as shown in FIG. 2. The wall of this embodiment may be erected in any of the erection methods described above if the panels are used in the channels of the shapes. When the channels are not used for carrying panels such as 140 and 144, the structural shapes are simply fastened to the building framework and the panels snapped into position with the clips. This embodiment of construction is suitable for panel carrying members arranged horizontally and vertically.

It is seen from FIG. 3 that widely varying thicknesses of panels are readily accommodated by varying the length of body portion 131 of the panel clips. As seen in FIG. 3, panel 143 is much thinner than panel 142 while the only difference in the structure is the length of the body portion of the panel clips. Thus, a number of clips having different length body portions would provide for widely varying thicknesses of panels with intermediate differences being compensated for by caulk strips such as shown as 152 and 153. Insulating panels 140 and 144 may be used, if desired, but if not desired, the space may be left open.

The construction system as shown in FIG. 3 has a great advantage in that the individual panels 142 and 143 may be readily replaced if damaged by cutting clip 130 at the junction of the body portion and leg, removing the damaged panel and simply forcing clip 130 into the open box section of the structural shape. The clips may also be removed by spreading the legs of the box section. A new panel 142 may then be installed in place utilizing new panels clips 130. Likewise, the wall may be disassembled in the same fashion without damage to the panels which may then be reused. This feature permits easy expansion or contraction of the building structure with reutilization of the same materials, requiring only new panel clips.

The clips and structural system as shown in FIGS. 9 and 10 of U.S. Pat. No. 3,974,608 in cross section and perspective cross section, may be used in the wall system described with respect to FIG. 3 utilizing either embodiment of the sheet metal shapes and either embodiment of the panel clip. The sheet metal structural shapes may be exposed to either the interior surface of the building or exposed to the exterior surface of the building.

The panel clip shown in the embodiment in FIG. 9 of the U.S. Pat. No. 3,974,608, is of the same general shape as the extending legs and flanges of the box section shown in FIG. 3 of this application. The panel clip shown in FIG. 9 of U.S. Pat. No. 3,974,608 has body section 161 with locking end 162, clip leg 163 at the other end of the body portion and the end of the clip leg turned up in portion 164 similar to flange end turnback 111, shown in FIG. 3 of this application. The action of clip 160 is the same as the clip 130. However, the clip leg turnback 164 is suitable for heavier gauge metal and provides a stiffer spring action against the panel 185. Wedge fastenings 175 may be inserted between panel clip leg portion 164 and panel 185 to assure tight fitting of the installed panel or caulk seal may be used.

The edge sheet 180 as shown in FIG. 9 of U.S. Pat. No. 3,974,608, may be used with the embodiments of the invention described herein. As shown in FIG. 9, a continuous sheet of metal or plastic for the length of the panel is inserted adjacent panel clip 160 to cover the exposed end of panel 185, which is exposed between the intermittent clips 160. When edge sheet 180 is metal, it also acts as a flame stop as well as a closure.

A facing strip may be used as shown in FIG. 9 of U.S. Pat. No. 3,974,608. Facing strip 170, a continuous strip for the length of panel 185 or butted evenly into end over a panel clip, extends the length of panel 185 and is snapped into position over edge sheet 180 and clip leg 164. The facing strip may desirably be fabricated from extruded plastic thus affording a weatherproof, resilient and permanently colored finished strip. Further, the design of the plastic facing strip 170 permits easy and protected caulking between leg 173 and panel 185, if desired. The facing strip can also be attached to the flange of the sheet metal structural shape. When the facing strips butt one another, as when adjacent panels are of the same thickness, they may readily be solvent welded to prevent bowing or looseness.

It should be apparent that the features described in U.S. Pat. No. 3,974,608 may be utilized with the wall construction described in this application.

The structural member clips as described herein, shown in FIGS. 4 and 5, may be used in both horizontal panel and vertical panel wall systems. Likewise, the walls may be erected with the box portion of the sheet metal structural shape on either side of the wall. The wall construction of this invention is suitable for exterior or interior walls. The wall construction of this invention provides an economical, easily erected structure which may be used for any type of building structure, particularly warehouses, utility buildings, and the like.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A panel wall construction of the type having alternating panels and panel carrying structural members comprising:

horizontal spaced sheet metal structural shapes of generally box-tee having three adjacent box walls, the fourth box wall being split into two segments, opposing legs extending away from the box section at about 90° from the ends of the split box walls for a distance to accommodate desired panels, the outer end of said legs extending away from each other forming flanges at about 90° to said legs and forming a channel to accept the edges of a wall panel;

lower sill sheet metal structural shape having the same design as said spaced shapes;

upper cap sheet metal structural shape having the same design as said spaced shapes;

said sill shape and cap shape aligned with said spaced shapes to accept panels in the channel of said sill and cap shape;

panels in said channels of each adjacent said spaced structural shapes and adjacent sill shape and cap edge locking said spaced shapes, sill shape and cap shaped into a rigid structure without separate fasteners; and vertical corner sheet metal structural shape assemblies comprising two of said sheet metal box-tee shapes having one flange of one shape inserted into the slot between opposing legs of the other box-tee shape.

2. The panel wall construction of claim 1 wherein multiple panels are used in the horizontal direction and the proximate edges of adjacent panels are sealed together by use of a caulk strip.

3. A panel wall construction of the type having alternating panels and panel carrying structural members comprising:

horizontal spaced sheet metal structural shapes of generally box-tee shape having three adjacent box walls, the fourth box wall being split into two segments, opposing legs extending away from the box section at about 90° from the ends of the split box walls for a distance to accommodate desired panels, the outer end of said legs extending away from each other forming flanges at about 90° to said legs and forming a channel which may accept the edges of a wall panel;

lower sill sheet metal structural shape having the same design as said spaced shapes;

upper cap sheet metal structural shape having the same design as said spaced shapes;

said sill shape and cap shape aligned with said spaced shapes which may accept panels in the channel of said sill shape and cap shape; and panels covering the space between the structural shapes, one surface of said panel abutting one of said legs of said shape, panel clips comprising a straight body portion having a locking end at one end and a clip leg at the other end so that said body portion may be inserted into the slot between opposing legs of said shape, the clip leg abutting the other surface of said panel and the locking end protruding into the hollow box portion of said shape locking the clip in position.

4. The panel wall construction of claim 3 wherein said spaced sheet metal structural shapes are horizontal spaced sheet metal structural shapes and said panel wall has vertical end mullions having the same design as said spaced shapes and aligned with said spaced shapes to accept panels in the channel of said mullions locking said spaced shapes, sill and cap shapes and vertical end mullions into a rigid structure without separate fasteners.

5. The panel wall construction of claim 3 wherein said structural shapes are attached to a building structure by a clip fastener, said clip fastener having a body portion terminating in a locking end, said body portion extending through the slot between opposing legs of said sheet metal structural shape and said locking end extending into said box section holding said clip, a slot in the body portion parallel to the legs of said structural shape and adapted to receive a wedge which holds said clip in secure locked position by force of one side of said wedge against the exterior end of said slot and the other side of said wedge against the flanges of said structural shape, the other end of said body portion having a clip leg at right angles to the body portion, said clip leg being secured to said building structure.

6. A panel wall construction of the type having alternating panels and panel carrying structural members comprising:

spaced sheet metal structural shapes of generally box-tee shape having three adjacent box walls, the fourth box wall being split into two segments, opposing legs extending away from the box section at about 90° from the ends of the split box walls for a distance to accommodate desired panels, the outer end of said legs extending away from each other forming flanges at about 90° to said legs and forming a channel to accept the edges of a wall panel;

lower sill sheet metal structural shape having the same design as said spaced shapes;

upper cap sheet metal structural shape having the same design as said spaced shapes;

said sill shape and cap shape aligned with said spaced shapes to accept a panel in said channel locking said spaced shapes, sill shape and cap shape into a rigid structure without separate fasteners; and panels in said channels of each adjacent said spaced structural shapes and adjacent sill shape and cap edge;

said structural shapes attached to a building structure by a clip fastener, said clip fastener having a body portion terminating in a locking end, said body portion extending through the slot between opposing legs of said sheet metal structural shape and said locking end extending into said box section holding said clip, a slot in the body portion parallel to the legs of said structural shape and adapted to receive a wedge which holds said clip in secure locked position by a force of one side of said wedge against the exterior end of said slot and the other side of said wedge against the flanges of said structural shape, the other end of said body portion having a clip leg at right angles to the body portion, said clip leg being secured to said building structure.

7. The panel wall construction of claim 6 wherein said wedge has at least one step on an angular edge to lock said wedge in said slot.

8. A panel wall construction of the type having alternating panel and panel carrying structural members comprising:

spaced sheet metal structural shapes of generally box-tee shape having three adjacent box walls, the fourth box wall being split into two segments, opposing legs extending away from the box section at about 90° from the ends of the split box walls for a distance to accommodate desired paneels, the outer end of said legs extending away from each other forming flanges at about 90° to said legs and forming a channel which may accept the edges of a wall panel;

lower sill sheet metal structural shape having the same design as said spaced shapes;

upper cap sheet metal structural shape having the same design as said spaced shapes;

said sill shape and cap shape aligned with said spaced shapes which may accept a panel in said channel locking said spaced shapes, sill shape and cap shape into a rigid structure without separate fasteners; and panels covering the space between the shapes, one surface of said panel abutting one of said legs of said shape, panel clips comprising a straight body portion having a locking end at one end and a clip leg at the other end so that said body portion may be inserted into the slot between opposing legs of said shape, the clip leg abutting the other surface of said panel and the locking end protruding into the hollow box portion of said shape locking the clip in position;

said structural shapes attached to a building structure by a clip fastener, said clip fastener having a body portion terminating in a locking end, said body portion extending through the slot between opposing legs of said sheet metal structural shape and said locking end extending into said box section holding said clip, a slot in the body portion parallel to the legs of said structural shape and adapted to receive a wedge which holds said clip in secure locked position by force of one side of said wedge against the exterior end of said slot and the other side of said wedge against the flanges of said structural shape, the other end of said body portion having a clip leg at right angles to the body portion, said clip leg being secured to said building structure.

9. The panel wall construction of claim 8 wherein said wedge has at least one step on an angular edge to lock said wedge in said slot.

* * * * *